United States Patent [19]

Natterer et al.

[11] Patent Number: 4,826,065

[45] Date of Patent: May 2, 1989

[54] FEEDING MEANS FOR FEEDING A MACHINE WEB IN A PACKAGING MACHINE

[75] Inventors: Johann Natterer, Legau; Ivo Ruzic, Kempten, both of Fed. Rep. of Germany

[73] Assignee: Multivac Sepp Haggenmüller KG, Wolfertschwenden, Fed. Rep. of Germany

[21] Appl. No.: 120,176

[22] Filed: Nov. 9, 1987

Related U.S. Application Data

[60] Continuation of Ser. No. 841,608, Mar. 20, 1986, abandoned, which is a division of Ser. No. 596,238, Apr. 2, 1984, Pat. No. 4,601,421.

[51] Int. Cl.[4] ..... B65H 17/34

[52] U.S. Cl. ..... 226/173

[58] Field of Search ..... 226/173, 170, 171, 172, 226/74, 75; 198/626, 627, 628, 694, 695, 696, 850, 851, 852, 853

[56] References Cited

U.S. PATENT DOCUMENTS

| | | | |
|---|---|---|---|
| 969,295 | 9/1910 | Meahl | 226/173 |
| 2,237,877 | 4/1941 | Fulk | 226/173 X |
| 2,557,492 | 6/1951 | Young | 226/173 X |
| 3,773,235 | 11/1973 | Canamero et al. | 226/173 X |
| 4,397,411 | 8/1983 | Vetter | 226/173 |

FOREIGN PATENT DOCUMENTS

| | | | |
|---|---|---|---|
| 316428 | 7/1974 | Austria . | |
| 39056 | 11/1981 | European Pat. Off. . | |
| 2123133 | 9/1972 | Fed. Rep. of Germany . | |
| 7118250 | 5/1973 | Fed. Rep. of Germany . | |
| 2161465 | 6/1973 | Fed. Rep. of Germany . | |
| 2224854 | 11/1973 | Fed. Rep. of Germany . | |
| 2355921 | 5/1975 | Fed. Rep. of Germany . | |
| 2535846 | 2/1976 | Fed. Rep. of Germany . | |
| 3001742 | 7/1981 | Fed. Rep. of Germany | 226/173 |
| 3022065 | 12/1981 | Fed. Rep. of Germany . | |

*Primary Examiner*—Harvey C. Hornsby
*Assistant Examiner*—Scott J. Haugland
*Attorney, Agent, or Firm*—Donald Brown; Robert T. Gammons

[57] ABSTRACT

A feeding means for feeding a material web in a packaging machine comprises feeding chains, sprocket wheels and an engagement element for feeding the feeding chains. In order to facilitate the insertion and clamping of the material web the engagement member is designed such that in a first portion of the travelling section the movable clamping member is lifted from the fixed clamping member in a substantially vertical direction and in a second portion of the travelling section following the first portion the movable clamping member is additionally moved laterally away from the edge of the material web to be gripped.

9 Claims, 6 Drawing Sheets

FEEDING MEANS FOR FEEDING A MACHINE WEB IN A PACKAGING MACHINE

This a continuation of co-pending application Ser. No. 841,608 filed on Mar. 20, 1986, now abandoned, which is a division of application Ser. No. 596,238 now U.S. Pat. No. 4,601,421 filed Apr. 2, 1984.

BACKGROUND OF THE INVENTION

The invention relates to feeding means for feeding a material web from an inlet side to an outlet side in a packaging machine comprising feeding chains disposed on both sides of the web and sprocket wheels for feeding the feeding chains, each feeding chain having chain links and clamps connected therewith for clamping the material web with a fixed clamping member connected with the associated chain link and a movable clamping member, and a compression spring for biasing the movable clamping member into the closed position, and an engagement element being adapted to engage the movable clamping member along a distance traversed by the chain.

A feeding means of the kind is known from the DE-OS No. 22 24 854. The fixed clamping members are rigidly connected with sleeves slidably guiding therein a bolt rigidly connected with the movable clamping members such that an inclination of the bolt and thus of the movable clamping member is avoided.

The AT-PS No. 31 64 28 shows a feeding chain having lateral angular butt straps attached to the chain links, wherein the lateral angular butt straps comprise horizontal bolts engaging slots provided at the movable clamping member. The engagement members cooperating with a feeding chain of that kind and being designed as engagement discs comprise pocket-like recesses cooperating with the chain links such that the movable clamping members are lifted and lowered in an inclined direction. Thus the clamping jaw of the movable clamping member is not vertically lowered onto the clamping jaw of the fixed clamping member and may thereby cause a displacement of the material web when the clamp is closed. Furthermore, the structure of the chain links as well as the one of the engagement disc is intricate.

OBJECTS OF THE INVENTION

It is a principal object of the invention to provide an improved feeding means of the above kind. It is a further object of the invention to provide feeding means allowing the edges of the material web to be securely gripped by the clamps without causing difficulties in feeding the web to the clamps, even if the width of the material web is not accurately constant. It is a further object of the invention to provide a feeding means avoiding the displacing of the material web towards the middle of the packaging machine when gripping the material web.

SUMMARY OF THE INVENTION

In accordance to the invention the feeding means comprises an engagement element adapted to engage the movable clamping member along a travelling section of the chain, wherein the engagement element is designed such that in a first portion of the travelling section the movable clamping member is lifted from the fixed clamping member in a substantially vertical direction and in a second portion of the travelling section following the first portion the movable clamping member is additionally moved laterally away from the edge of the material web to be gripped.

BRIEF DESCRIPTION OF THE DRAWINGS

The invention is hereinafter more particularly described with reference to embodiments shown in the accompanying drawings. In the drawings.

Figure 1:
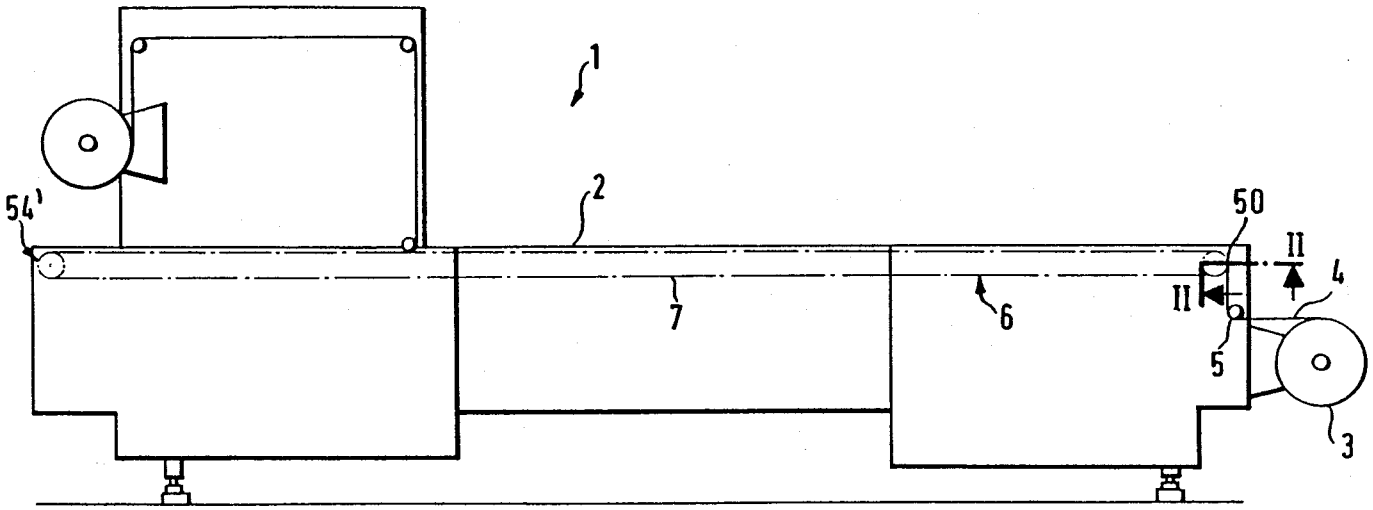
FIG. 1 is a lateral view of a packaging machine with feeding means in schematic representation.

The invention may in particular be applied to a deep-drawing packaging machine, which is generally denoted with reference number 1 in FIG. 1. This packaging machine comprises a machine frame 2 having an inlet side where a reel 3 with foil material is disposed, the material web 4 being drawn off from this foil material and being fed over a guide roller 5 to a feeding means 6.

The feeding means 6 in a known manner comprises endless strands of chain 7 being fed over and driven by sprocket wheels at their return points. In a known manner clamps for laterally clamping the material web 4 and for feeding the web through the processing stations of the deep-drawing packaging machine are mounted to the chain links. At the outlet side the material web is released from the clamps.

Figure 2:
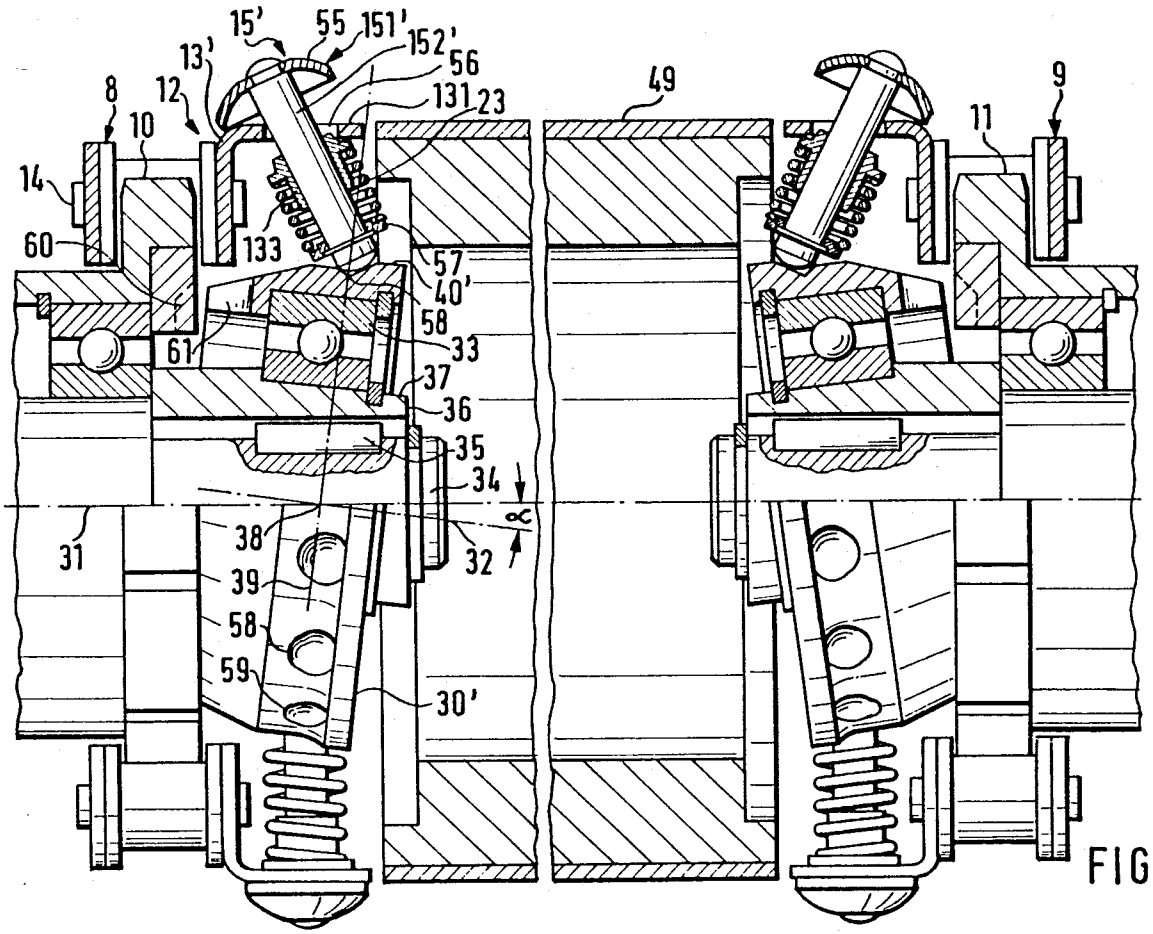
FIG. 2 is a section view of a part of a first embodiment of the inventive packaging machine, along line II—II in FIG. 1.

As may be best seen from FIG. 2 the feeding chains 8, 9 run on sprocket wheels 10, 11 being in a known manner supported in the machine frame 2 by means of roller bearings and shafts. The left and right strand of chain with the associated drive means are symmetrically designed. Hence only one side is further described.

Figure 3:
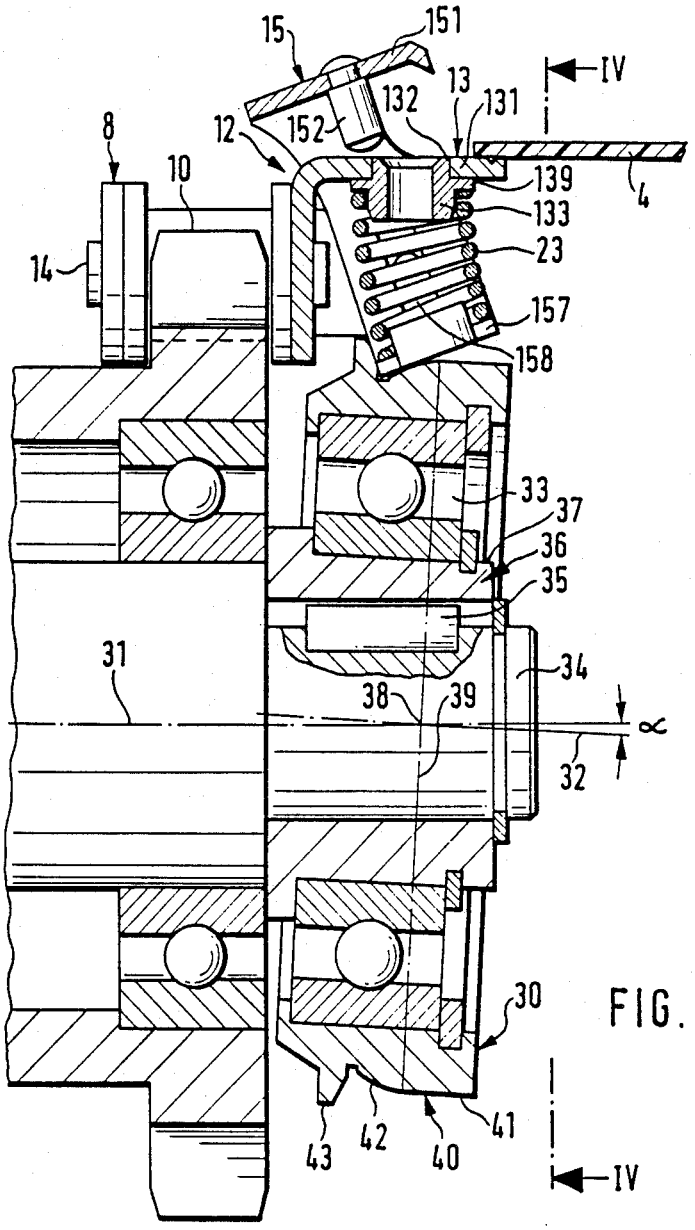
FIG. 3 is a partial representation of a second embodiment corresponding to the left half of the representation shown in FIG. 2, along line III—III in FIG. IV.
Figure 4:
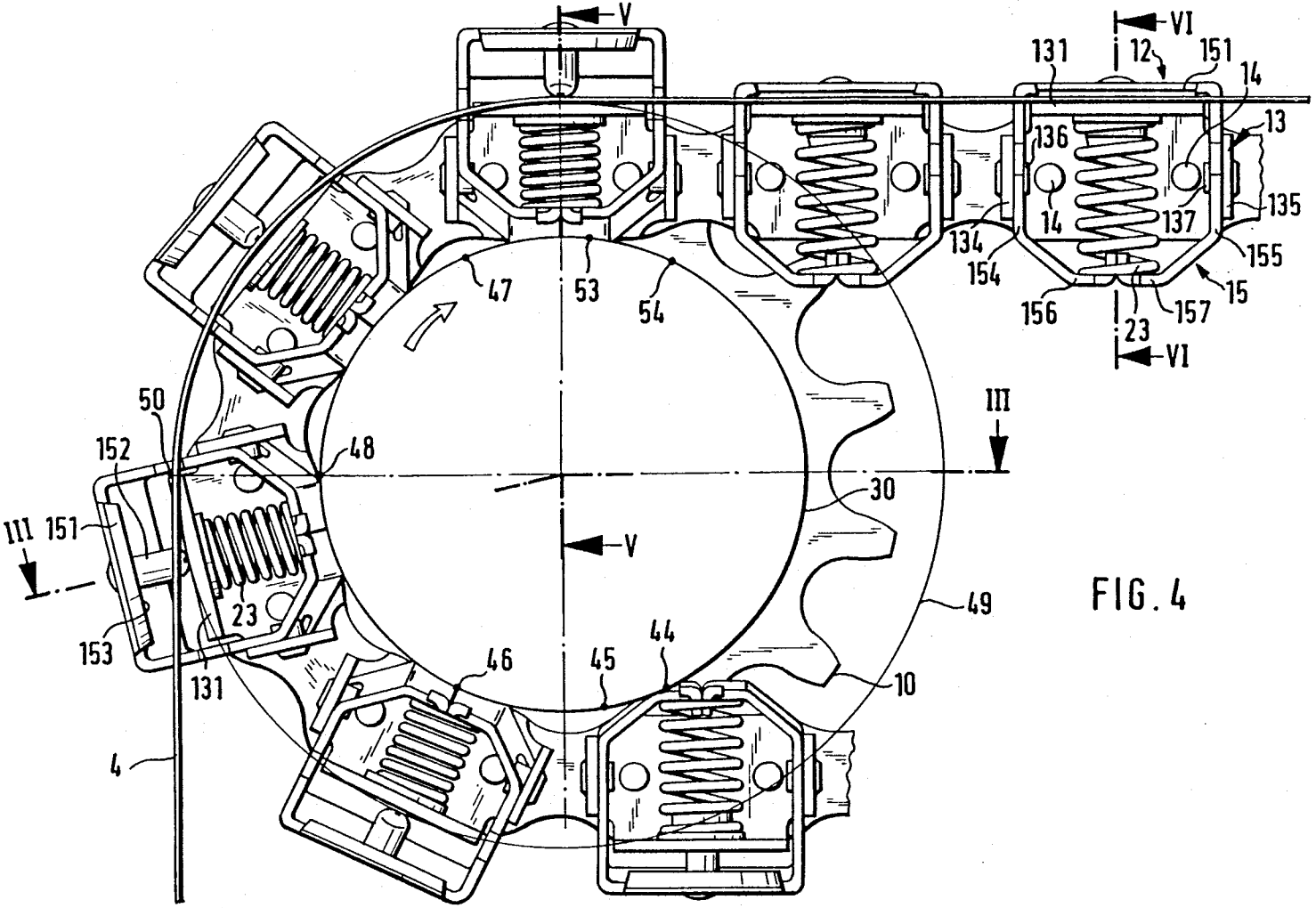
FIG. 4 is a lateral view of the feeding chain with engagement disc in the direction of arrows IV—IV in FIG. 3, turned by 90°.
Figure 5:
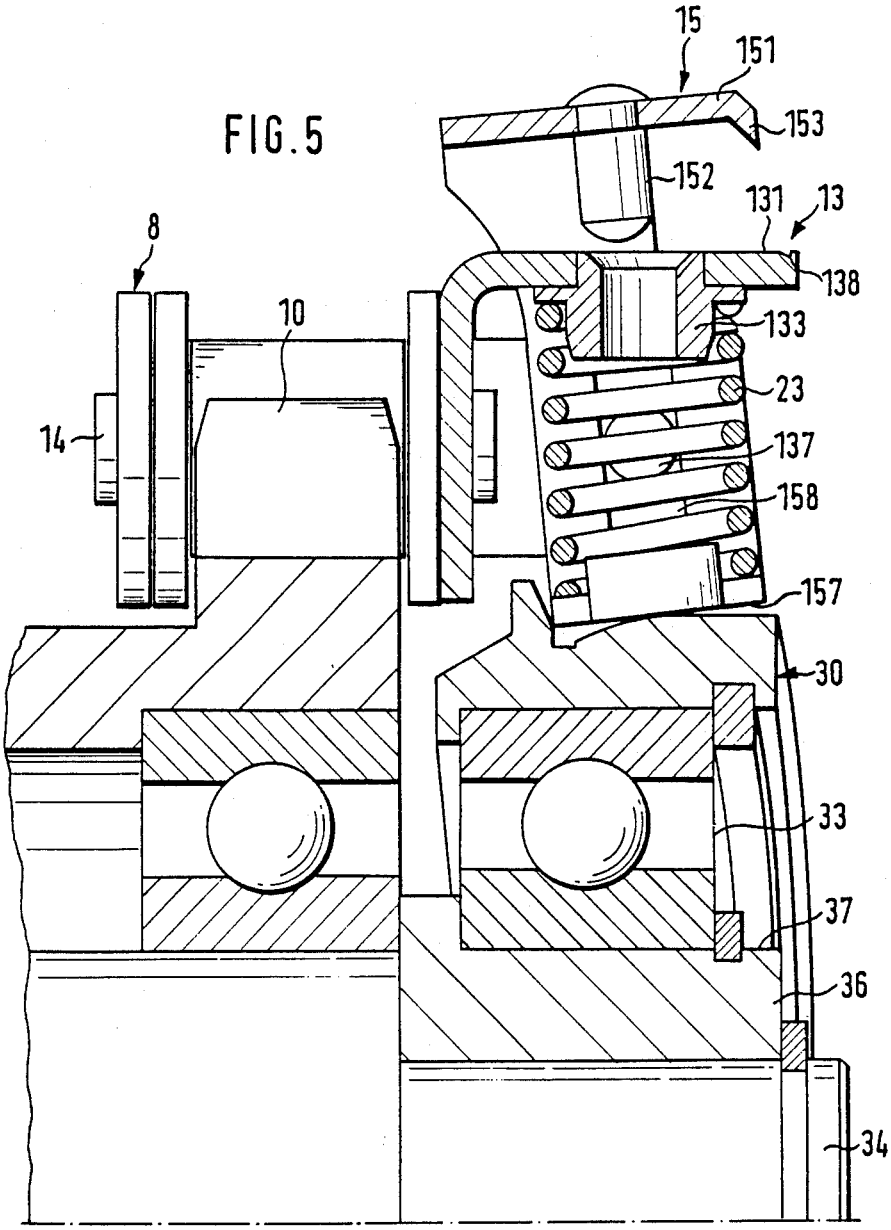
FIG. 5 is a sectional view along line V–V in FIG. 4.

To begin with the embodiment shown in the FIGS. 3–5 is described in the following. In this embodiment each chain link comprises a clamp 12. This clamp comprises a fixed clamping member 13 in the form of an angular buttstrap riveted to the bolt 14 of the chain link. Furthermore there is provided a movable clamping member 15 being designed inform of a box-like clamp with a movable clamping jaw 151, lateral walls 154, 155 and lower bent-over supports 156, 157. The fixed clamping member 13 comprises a fixed clamping jaw 131 with a bore 132. A flange sleeve 133 is provided coaxially with this bore at the underside of the fixed clamping jaw 131, the flange sleeve being rigidly connected with the clamping jaw. A compression spring 23 biasing the movable clamping jaw 151 into the closed position is provided between the flange 139 of the flange sleeve and the lower legs of the movable clamping member forming the supports 156, 157.

The movable clamping jaw 151 comprises an edge 153 disposed at the end thereof turned away from the chain, the edge engaging into a notch 138 provided at the fixed clamping jaw 131 in the closed position.

A fixing bolt 152 being rigidly riveted to the movable clamping jaw is provided at the underside of the upper part of the movable clamping jaw facing the fixed clamping jaw, the fixing bolt being arranged such that in the closed state of the clamp the fixing bolt is aligned coaxially with the flange sleeve 133 and that its outer diameter is selected such that the bolt may slide within the flange sleeve. Its length is selected such that it is first guided a distance within the flange sleeve and thereafter emerges therefrom.

The fixed clamping member 13 comprises two lateral parts 134, 135 in the form of flaps bent forwardly substantially at a right angle. Guide pins 136, 137 are riveted into the respective flaps. The movable clamping member 15 comprises oblong holes 158 in the side walls 154, 155 thereof. The oblong holes 158 extend parallel to the direction of the bolt 152. The bolt-shaped designed guide pins 136, 137 are received by the adjacent oblong holes 158.

Figure 6:
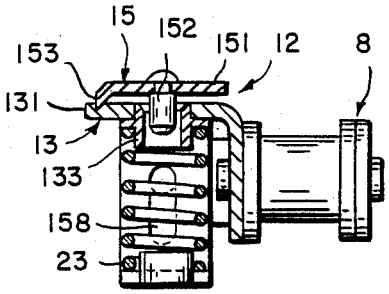
FIG. 6 is a sectional view of a closed clamp according to the second embodiment, along line VI–VI in FIG. 4.

FIG. 6 shows a section through a closed clamp according to the embodiment shown in the FIGS. 3–5. In this closed state the movable clamping jaw 151 with the edge 153 is pressed towards the fixed clamping jaw 131 by means of the compression spring 23. Thereby the bolt 152 is moved into the flange sleeve 133 to a certain extent. It may be seen from FIG. 6 that in lifting or lowering the movable clamping member 15 this is moved in a direction perpendicular to the fixed clamping jaw 131 as long as the bolt 152 is guided in the flange sleeve 133.

An engagement disc 30 is provided adjacent to the sprocket wheel, the engagement disc being disposed between the clamps returned around the sprocket wheel axis and serving for opening the clamping jaws for insertion and clamping and releasing, respectively, of the material web 4 to be fed. The engagement disc 30 is disposed concentrically with the sprocket wheel axis 31. The axis 32 of the engagement disc forms an angle $\alpha$ with the sprocket wheel axis 31. The engagement disc 30 is rotatably supported by means of a ball bearing 33. The sprocket wheel 10 and the engagement disc 30 are both supported on a common sprocket wheel shaft 34. In order to incline the engagement disc 30 a boss 36 is provided being keyed to the sprocket wheel shaft 34 by means of a wedge 35 and having a journal 37. The axis of the journal 37 coincides with the axis 32 of the engagement disc and forms an angle $\alpha$ with the boss axis coinciding with the sprocket wheel axis 31. The axis of the journal is pivoted about the angle $\alpha$ in a point 38 defined as the point of intersection of a line of intersection 39 passing the middle of the engagement surface and the sprocket wheel axis 31. The position of the engagement disc 30 may be adjusted by adjusting the rotational position of the boss 36 and the sprocket wheel shaft 34, respectively, with respect to the sprocket wheel axis 31.

The engagement disc 30 comprises an engagement surface 40 having, as may be best seen from FIG. 3, a plane section 41 at the side thereof facing the material web 4 to be clamped, the plane section extending from the outer edge of the engagement disc facing the material web to the line of intersection 39. This section is followed by a convex section 42 being defined by a projecting guide flange 43.

The clamp 12 is opened by engagement thereof with the engagement disc 30 at point 44 (FIG. 4). By guiding the bolt 152 in the flange sleeve 133 and the guide pins 136, 137 in the oblong holes 158 the movable clamping member 15 is lifted vertically until the bolt 152 emerges from the flange sleeve 133 about at point 45. At this point the convex section is brought into engagement with the supports 156, 157, as shown in FIG. 5, due to the inclined engagement disc 30. Now, i.e. after lifting the movable clamping member, a tilting action is started due to the increasing distance of the engagement surface 40 from the sprocket wheel 10 because of the inclination of the engagement disc 30. During this tilting action the movable clamping member is tilted through the position shown in FIG. 5 into the position shown in FIG. 3 riding on the convex section and being guided by the guide flange 43. Thus the width of the convex section 42 is selected such that starting from point 45 the movable clamping member 15 steadily swings further outwardly into the inclined position shown in FIG. 3 forceably guided by the convex section moving away from the sprocket wheel 10 and the guide flange 43. At point 46 the clamp is totally opened and remains in the opened position until point 47. The maximal lateral displacement is reached at point 48.

As may be best seen from FIG. 2 a guide drum 49 for deflecting the material web 4 drawn from the supply reel 3 is freely rotatable supported between the opposed sprocket wheels 10, 11. The position of the engagement disc 30 is adjusted such that the maximum distance of the engagement surface 40 from the adjacent sprocket wheel 10 is reached at the angular position corresponding to point 48, lying on that radius intersecting the rotational axis of the engagement disc and the guide drum on which also point 50 is positioned, where the material web 4 meets the guide drum 49. In the embodiment shown in FIG. 1 this point 50 lies on a horizontal line passing through the mentioned center. It is thus achieved that at the inlet point of the material web the movable clamping jaw 151 cooperating with the fixed clamping jaw 131 formed as horizontal leg is swung out to such an extent that the material web 4 may be inserted and guided onto the fixed clamping jaw 131 without a contact of the material web 4 with the movable clamping jaw 151. After turning further beyond point 48 the movable clamping member 15 first swings back into the vertical position until point 53. At point 53 the bolt 152 enters the flange sleeve 133, which is followed by a vertical backward movement of the movable clamping member into the closed start position, wherein the movable clamping jaw firmly clamps the material web 4 in cooperation with the fixed clamping jaw 131. At point 54 the closed end position is reached. At the outlet side 54' both engagement discs are correspondingly designed such that there the opening and closing operation is performed in a corresponding manner and the material web is released.

In the first embodiment shown in FIG. 2 the features corresponding to the above described embodiment are characterized by the same reference numerals. Again both sides are designed symmetrical with each other and thus only one side is described.

The fixed clamping member 13' is designed as an angle piece having a vertical leg being connected with the chain link by means of the bolt 14 and a horizontally fixed clamping jaw 131. The fixed clamping jaw comprises a bore 56. The movable clamping member 15' comprises a fixing bolt 152' being provided at its end turned away from the engaging disc 30' with a movable clamping jaw 151' designed as a head riveted thereon and designed as a mushroom or sperical segment. In the closed state the movable clamping jaw 151 clamps and holds a material web in cooperation with the fixed clamping jaw 131. The bolt 152' has a ring 57 on its side turned away from the head and close to its other end. Differing from the first embodiment the flange sleeve 133 is not rigidly connected with the fixed clamping jaw 131. The compression spring 23 is provided between the flange sleeve 133 and the ring 57, one end thereof resting against the flange sleeve 133 and the other end against the ring 57, and biases the movable clamping member 13' into the closed position.

The engaging disc 30' is supported in a manner similar to that of the above described embodiment. The engagement surface 40', however, differs from the above embodiment. The engagement disc comprises centering bores 58 which in the embodiment shown are formed as blind bores. The centering bores 58 are arranged on a circumferential line in a circumferentially staggered manner. Their angular distance corresponds to the angular distance of the clamps 12 fed around the sprocket wheel. The engaging disc 30' comprises a plurality of circumferentially staggered recesses 61 on the side facing the sprocket wheel 10. The sprocket wheel 10 comprises a corresponding plurality of projecting portions 60 on its side 59 facing the engagement disc 30, the projecting portions being formed such that they may be brought into engagement with an adjacent recess 61. The projecting portions 60 are arranged such that they come into engagement in the region where the engagement disc and the sprocket wheel are closer adjacent to each other.

The centering bores 58 are circumferentially distributed such that in a direction parallel to the axis 31 a centering bore 58 is associated to a respective clamp. The centering bores take over the guiding of the respective bolts in that way that these engage with the associated bores and are guided and retained therein. The lateral dislocation is performed by the side wall of the centering bore which corresponds to the guide flange 43 of the first described embodiment.

It should be understood that the above description is in no way limitative and that many modifications and improvements may be brought thereto without departing from the true spirit of the invention.

What is claimed is:

1. Feeding means for feeding a material web from an inlet side to an outlet side in a packaging machine comprising feeding chains disposed on both sides of the web and sprocket wheels for guiding the feeding chains along a predetermined path, each feeding chain comprising chain links and clamps connected thereto for gripping the edge of the material web, said clamps embodying fixed clamping members and movable clamping members and compression springs for biasing the movable clamping members into engagement with the fixed clamping members and further comprising engagement elements operable by engagement with the movable clamping members as the chains travel around the sprocket wheels to lift the movable clamping members from the fixed clamping members, said engagement elements comprising a disk rotatable around an axis of rotation which is angled relative to the axes of the sprocket wheels, said movable clamping members comprising first movable clamping members on one of said chains, said disk engaging said first movable clamping members at points of contact lying on the periphery of said disk in a plane which is inclined to the plane of the sprocket wheels, whereby the disk first lifts, said first the movable clamping members vertically and thereafter laterally away from the fixed clamping members as the chains travel around the sprocket wheels.

2. Feeding means according to claim 1 wherein said axis of rotation is inclined with respect to the axes of the sprocket wheels such that the distance between said points of contact on the disk and one of the sprocket wheels at a side where the web is fed to said one sprocket wheel is greater than the distance between them 180° therefrom in the direction of rotation of said one sprocket wheel when the chain travels around said one sprocket.

3. Feeding means according to claim 2 wherein the distance between said points of contact on the disk and said one sprocket wheel is at a maximum at the side where the web is fed to said one sprocket wheel.

4. Feeding means according to claim 2 wherein the disk at a side where the web is released is inclined relative to said one sprocket wheel at an angle corresponding to the angle between the axis of rotation and the axis of said one sprocket wheel.

5. Feeding means according to claim 1 wherein said disk comprises centering bores for engagement with said first movable clamping members, said centering bores forming said points of contact.

6. Feeding means according to claim 1 wherein said disk comprises a peripheral surface which is formed to comprise in a plane perpendicular to the axis of rotation, a projecting guide flange at a side of the disk facing one of the sprocket wheels, the guide flange being followed by a convex section and a straight section.

7. The feeding means of claim 1 wherein the fixed and movable clamping members each comprise lateral parts, the lateral parts of one clamping member having a hole and the lateral parts of the other clamping member having a bolt-type pin guided in the hole.

8. The feeding means of claim 1 wherein each clamp comprises a bolt rigidly connected with each movable clamping member and a hole in each fixed clamping member having a sleeve therein and wherein each bolt is disposed substantially parallel to one of the holes and guided is in its sleeve.

9. The feeding means of claim 8 wherein each sleeve is rigidly connected with its fixed clamping member.

* * * * *